US009616434B2

(12) United States Patent
Pan

(10) Patent No.: US 9,616,434 B2
(45) Date of Patent: Apr. 11, 2017

(54) FLUID SWITCHING APPARATUS

(71) Applicant: NINGBO JIEYI SANITARY WARE CO., LTD., Zhejiang (CN)

(72) Inventor: Yinchun Pan, Zhejiang (CN)

(73) Assignee: NINGBO JIEYI SANITARY WARE CO., LTD., Zhejiang (CN)

( * ) Notice: Subject to any disclaimer, the term of this patent is extended or adjusted under 35 U.S.C. 154(b) by 0 days.

(21) Appl. No.: 14/824,135

(22) Filed: Aug. 12, 2015

(65) Prior Publication Data

US 2016/0167062 A1 Jun. 16, 2016

(30) Foreign Application Priority Data

Dec. 10, 2014 (CN) ..... 2014 1 0755885
Dec. 10, 2014 (CN) ..... 2014 2 0778473 U

(51) Int. Cl.
*B05B 1/18* (2006.01)
*B05B 1/16* (2006.01)

(52) U.S. Cl.
CPC ..... *B05B 1/1636* (2013.01); *B05B 1/1654* (2013.01); *B05B 1/18* (2013.01)

(58) Field of Classification Search
CPC ..... B05B 1/18; B05B 1/185; B05B 1/1636; B05B 1/1654
USPC ..... 251/230, 249.5, 250
See application file for complete search history.

(56) References Cited

U.S. PATENT DOCUMENTS 802,954 A * 10/1905 Waterman ..... F16K 31/44 251/115
4,598,863 A * 7/1986 Kanesaka ..... F02M 57/02 239/94
8,177,147 B2 * 5/2012 Engel ..... B05B 1/1654 239/443
8,632,023 B2 * 1/2014 Miller ..... B05B 1/1636 239/443
2013/0247294 A1 * 9/2013 Zhou ..... B05B 1/1636 4/615

FOREIGN PATENT DOCUMENTS

CN 202962707 6/2013

* cited by examiner

*Primary Examiner* — Alexander Valvis
(74) *Attorney, Agent, or Firm* — Andrew F. Young, Esq.; Lackenbach Siegel, LLP

(57) ABSTRACT

The present patent application discloses a fluid switching apparatus. The fluid switching apparatus includes a positioning device, a second rotor, a first rotor, and a button which is mounted on a side of the first rotor. The positioning device, the second rotor and the first rotor are arranged coaxially from left to right. Two or more nozzles are arranged circumferentially on the positioning device. A plurality of blocks is provided on the second rotor. As the rotation of the second rotor, the blocks may sequentially block different nozzles. The button is used for driving the first rotor to rotate. The first rotor drives the second rotor to rotate. The transmission of the first rotor and the second rotor is unidirectional.

9 Claims, 3 Drawing Sheets

FLUID SWITCHING APPARATUS

CROSS REFERENCE TO RELATED APPLICATIONS

This application relates to and claims priority from CH Ser. No. 201410755885.6 filed Dec. 10, 2014 and CH Ser. No. 201420778473.x filed Dec. 10, 2014, the entire contents of each of which are incorporated herein by reference.

FIGURE SELECTED FOR PUBLICATION

FIG. 2

BACKGROUND OF THE INVENTION

Technical Field

The present patent application relates to a fluid switching field, and particularly relates to a fluid switching apparatus.

Background

Chinese patent application No. CN201220538062.4, the contents of which are fully incorporated by reference, discloses a showerhead. The fluid switch in the shower is realized by rotation of the rotor so that the water outlet holes on the rotor align to the different divergent holes on the water diversion plate. In this fluid switch, the fluid needs to flow through the entire fluid switching apparatus, resulting in a large loss of flow velocity. Further, there is a high tightness requirement for the fluid switching apparatus as the fluid needs to flow through the entire fluid switching apparatus. The entire fluid switching apparatus is complex. There is a kinetic energy loss during the operation, resulting in the need to increase the brake displacement to achieve the switching off or control functions.

ASPECTS AND SUMMARY OF THE INVENTION

To improve the deficiency of the related art, the present patent application provides a fluid switching apparatus with improved clever structure and smaller energy loss.

To achieve the above aspects, the present patent application provides, in combination, a fluid switching apparatus. The fluid switching apparatus includes a positioning device, a second rotor, a first rotor, and a button which is mounted on a side of the first rotor. The positioning device, the second rotor and the first rotor are arranged coaxially from left to right. Two or more nozzles are arranged circumferentially on the positioning device. A plurality of blocks is provided on the second rotor. As the rotation of the second rotor, the blocks may sequentially block different nozzles. The button is used for driving the first rotor to rotate. The first rotor drives the second rotor to rotate. The transmission of the first rotor and the second rotor is unidirectional.

As another aspect of the present invention, the fluid switching apparatus further includes a spring which is used for pushing the second rotor toward the positioning device. The positioning device is provided with a plurality of circumferentially arranged positioning grooves which are connected to each other. The second rotor is provided with a positioning projections; an inclined surface is provided on the positioning groove or/and the positioning projection. As the second rotor rotates in relative to the positioning device, the positioning projection successively slips out of different positioning groove.

As a further aspect of the present invention, the first rotor and the second rotor are axially slidable. The spring is mounted on a right end of the first rotor; and the spring urges the first rotor and the second rotor successively.

As a further aspect of the present invention, the first rotor is provided with a plurality of axially projecting first ratchet. The second rotor is provided with a plurality of axially projecting second ratchet. The first ratchet meshes with the second ratchet, and the first ratchet, the second ratchet and the spring constitute a unidirectional transmission device.

As a further aspect of the present invention, a straight gear is provided on the button. A circular gear is provided on the first rotor. The button drives the first rotor to rotate by coordinating the straight gear and the circular gear.

As a further aspect of the present invention, a transmission is provided between the button and the first rotor and is a crank mechanism.

As a further aspect of the present invention, the fluid switching apparatus further includes a return spring, and the return spring is positioned at the lower end of the button for resetting the button.

As a further aspect of the present invention, it is recognized that since the fluid flows through few parts, the fluid switching apparatus can effectively reduce the loss of flow. The button for controlling the fluid switch is mounted on the side of the pipe. It is easy to install and use. The fluid switching apparatus has a compact and simple structure, with a few parts. It is easy for manufacture. The sealing effect is good.

The above and other aspects, features and advantages of the present invention will become apparent from the following description read in conjunction with the accompanying drawings, in which like reference numerals designate the same elements.

Figure 1:
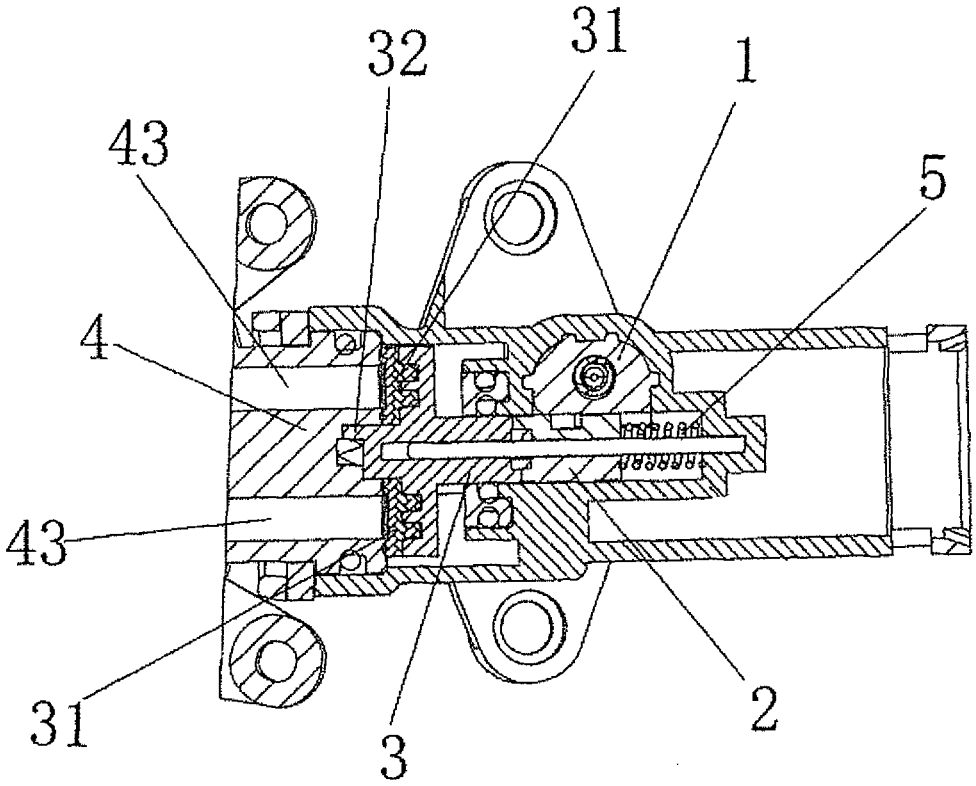
FIG. 1 illustrates an overall partial sectional view of the structure of the fluid switching apparatus according to an embodiment of the present patent application.

In the drawings, 1: button, 2: a first rotor, 3: a second rotor, 4: positioning device, 5: spring, 11: straight gear, 21: circular gear, 22: a first ratchet, 31: block, 32: positioning projection, 33: a second ratchet, 41: positioning groove, 42: boundary line, 43: nozzle.

The embodiments depicted in the figures are only exemplary. One skilled in the art will readily recognize from the following discussion that alternative embodiments of the structures and methods illustrated herein can be employed without departing from the principles described herein.

DETAILED DESCRIPTION OF THE PREFERRED EMBODIMENTS

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the present technology. Thus, the disclosed technology is not intended to be limited to the examples described herein and shown, but is to be accorded the scope consistent with the claims.

Figure 2:
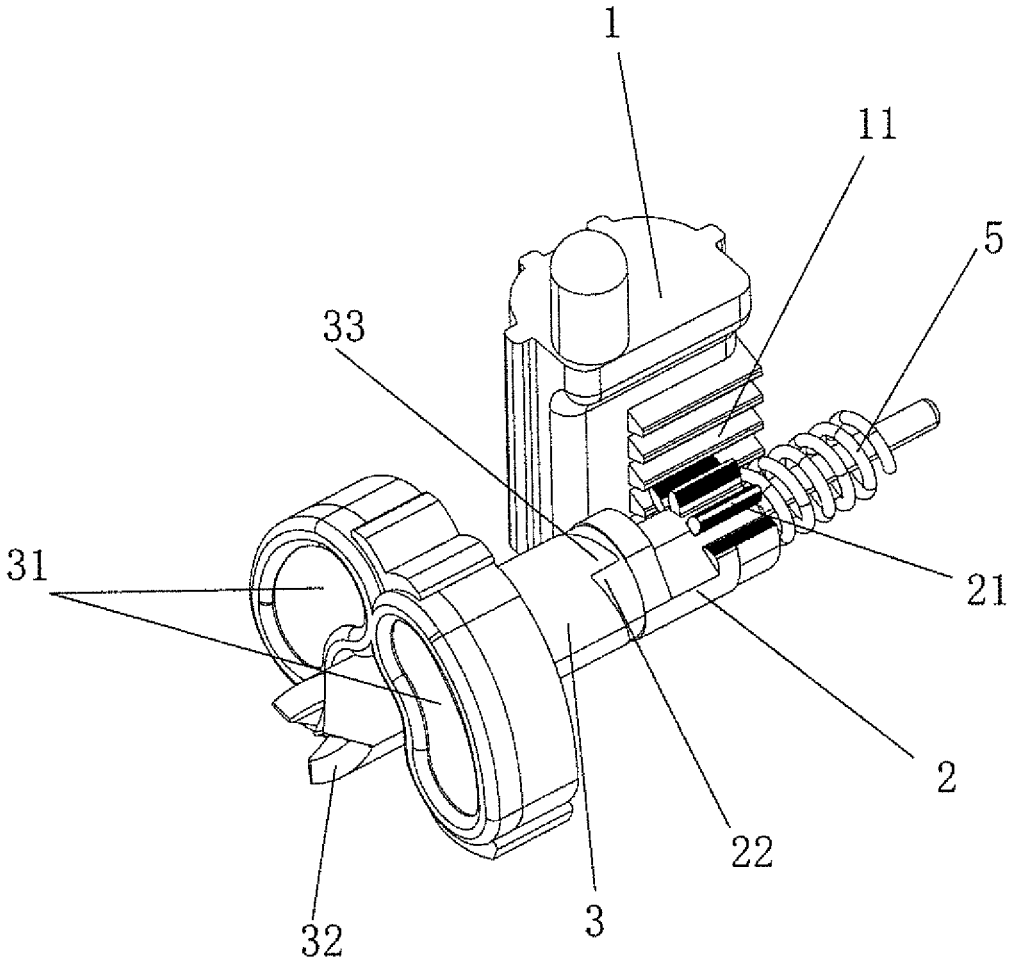
FIG. 2 illustrates the main moving parts of the fluid switching apparatus according to the embodiment of the present patent application.
Figure 3:
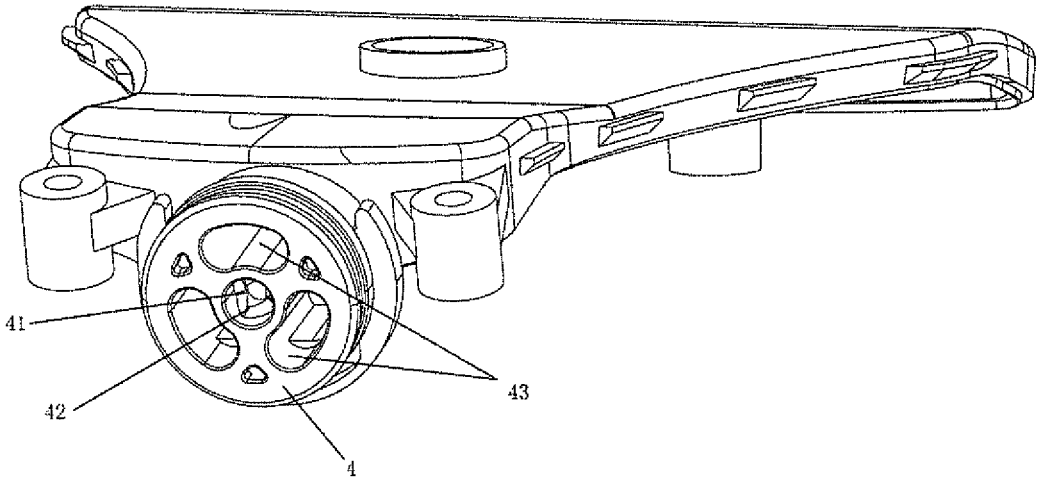
FIG. 3 illustrates the positioning device of the fluid switching apparatus according to the embodiment of the present patent application.

Referring to FIGS. 1, 2 and 3, a fluid switching apparatus includes a positioning device 4, a second rotor 3, a first rotor 2, and a button which is mounted on a side of the first rotor 2. The positioning device 4, the second rotor 3 and the first rotor 2 are arranged coaxially from left to right. Two or more nozzles 43 are arranged circumferentially on the positioning device 4. A plurality of blocks 31 are provided on the second rotor 3. As the rotation of the second rotor 3, the blocks 31 may sequentially block different nozzles 43. The button 1 is used for driving the first rotor 2 to rotate. The first rotor 2 drives the second rotor 3 to rotate during a use thereof. The transmission of the first rotor 2 and the second rotor 3 is unidirectional during the use.

The nozzle 43 (See FIGS. 1 and 3) can be a through hole which is connected with the outlet. The nozzle 43 can also be a virtual nozzle which is closed and not used for water to pass through but for the block to stop. In the present patent application, the fluid switching apparatus includes at least two nozzles 43. Each nozzle 43 corresponds to a tap position. In the present patent application, the fluid switching apparatus has at least two tap positions.

In this embodiment, the fluid switching apparatus also includes a return spring. A straight gear 11 is provided on the button. A circular gear 21 is provided on the first rotor 2. The button 1 drives the first rotor 2 to rotate by coordinating the straight gear 11 and the circular gear 21. The return spring is positioned at the lower end of the button 1 for resetting the button 1. Each time, when the button is pressed, it drives the first rotor 2 to rotate. The first rotor 2 then drives the second rotor 3 to rotate, so that the block 31 on the second rotor 3 corresponds to different nozzle 43. When the return spring reset the button, the button drives the first rotor 2 to rotate reversely. Since the transmission between first rotor 2 and the second rotor 3 is unidirectional, the first rotor 2 idles with respect to the second rotor 3. At this time, the second rotor 3 does not rotate; and the block 31 still blocks the original nozzle 43. Further, the transmission between the button 1 and the first rotor 2 can be a crank mechanism.

In order to let the block 31 align with the nozzle 43, a critical point and integrating point are set up between the second rotor 3 and the positioning device 4. Prior to the critical point, the rotation of the second rotor 3 relative to the positioning device 4 without applying an external force will automatically rotate to an integrating point. When the second rotor 3 rotates after the critical point, the second rotor 3 rotates to the next integrating point without applying an external force. In order to create the critical point and the integrating point, in this embodiment, the positioning device 4 has a plurality of circumferentially arranged positioning grooves 41 connected to each other. A positioning projection 32 is provided on the second rotor 3. An inclined surface is provided on the positioning groove 41 or/and the positioning projection 32. As the second rotor 3 rotates in relative to the positioning device 4, the positioning projection 32 successively slips out of different positioning groove 41. The bottom of the positioning groove 41 constitutes an integrating point. The boundary line 42 between the two positioning grooves 41 constitutes a critical point. The inclined surface constitutes the transition section.

Further, the first rotor 2 and the second rotor 3 are axially slidable. The spring 5 is mounted on the right end of the first rotor 2. The spring 5 urges the first rotor 2 and the second rotor 3 successively. The first rotor 2 is provided with a plurality of axially projecting first ratchet 22. The second rotor 3 is provided with a plurality of axially projecting second ratchet 33. The first ratchet 22 meshes with the second ratchet 33. The first ratchet 22, the second ratchet 33 and the spring 5 constitute a unidirectional transmission device. The operation principle of the unidirectional transmission device is similar to ordinary ratchet mechanism.

The mounting method of the spring 5 can be varied. In this embodiment, the first rotor 2, the second rotor 3 and the positioning device 4 can be integrated. One spring 5 is used for forming the unidirectional transmission device between the first rotor 2 and the second rotor 3 and the critical point and integrating point mechanism between the second rotor 3 and the positioning device 4. The whole structure is simple and compact, having a good use result.

Since the fluid flows through few parts, it can effectively reduce the loss of flow. The button for controlling the fluid switch is mounted on the side of the pipe. It is easy to install and use. The fluid switching apparatus has a compact and simple structure, with a few parts. It is easy for manufacture. The sealing effect is good.

Various exemplary embodiments are described herein. Reference is made to these examples in a non-limiting sense. They are provided to illustrate more broadly applicable aspects of the disclosed technology. Various changes can be made and equivalents can be substituted without departing from the true spirit and scope of the various embodiments. In addition, many modifications can be made to adapt a particular situation, material, composition of matter, process, process act(s) or step(s) to the objective(s), spirit or scope of the various embodiments. Further, as will be appreciated by those with skill in the art, each of the individual variations described and illustrated herein has discrete components and features which can be readily separated from or combined with the features of any of the other several embodiments without departing from the scope or spirit of the various embodiments.

The invention claimed is:

1. A fluid switching apparatus comprising:

a positioning device, a second rotor, a first rotor, and a button which is mounted on a side of the first rotor, wherein the positioning device, the second rotor and the first rotor are arranged coaxially;

two or more nozzles are arranged circumferentially on the positioning device;

a plurality of blocks are provided on the second rotor;

wherein upon rotation of the second rotor the plurality of blocks sequentially block the two or more nozzles;

the button drives the first rotor to rotate;

when the first rotor rotates in a first rotation direction, the first rotor drives the second rotor to rotate, and when the first rotor rotates in a reverse second rotation direction, the second rotor does not rotate;

the fluid switching apparatus further comprises a spring which pushes the second rotor toward the positioning device; the positioning device is provided with a plurality of circumferentially arranged positioning grooves which are connected to each other, the second rotor is provided with a positioning projection; an inclined surface is provided on each of the plurality of positioning grooves and the positioning projection, and as the second rotor rotates relative to the positioning device, the positioning projection successively slips out of one of the plurality of positioning grooves; and a bottom of each of the plurality of positioning grooves defines an integrating point, a boundary line between each two of the plurality of positioning grooves defines a critical portion, and the inclined surface of the plurality of positioning grooves and the positioning projection defines a transition section; prior to each critical portion, a rotation of the second rotor relative to the positioning device automatically rotates to a previous integrating point without applying an external force; after the critical portion, the rotation of the second rotor relative to the positioning device automatically rotates to a next integrating point without applying the external force.

2. The fluid switching apparatus of claim 1, wherein the first rotor and the second rotor are axially slidable, the spring is mounted to the first rotor; and the spring urges the first rotor and the second rotor successively.

3. The fluid switching apparatus of claim 1, wherein the first rotor is provided with a plurality of first ratchets, the second rotor is provided with a plurality of second ratchets, the plurality of first ratchets axially mesh with the plurality of second ratchets, and the plurality of first ratchets, the plurality of second ratchets and the spring constitute a unidirectional transmission device of said plurality of blocks.

4. The fluid switching apparatus of claim 1, wherein a straight gear is provided on the button, a circular gear is provided on the first rotor, and the button drives the first rotor to rotate by coordinating the straight gear and the circular gear.

5. The fluid switching apparatus of claim 2, wherein a straight gear is provided on the button, a circular gear is provided on the first rotor, and the button drives the first rotor to rotate by coordinating the straight gear and the circular gear.

6. The fluid switching apparatus of claim 3, wherein a straight gear is provided on the button, a circular gear is provided on the first rotor, and the button drives the first rotor to rotate by coordinating the straight gear and the circular gear.

7. The fluid switching apparatus of claim 1, wherein a transmission between the button and the first rotor is a crank mechanism.

8. The fluid switching apparatus of claim 2, wherein a transmission between the button and the first rotor is a crank mechanism.

9. The fluid switching apparatus of claim 3, wherein a transmission between the button and the first rotor is a crank mechanism.

* * * * *